US010138096B2

(12) United States Patent
Muench et al.

(10) Patent No.: US 10,138,096 B2
(45) Date of Patent: Nov. 27, 2018

(54) AUTOMATIC ERECTION OF A CRANE

(71) Applicant: Liebherr-Werk Ehingen GmbH, Ehingen/Donau (DE)

(72) Inventors: Nikolaus Muench, Mehrstetten (DE); Robert Krutz, Munderkingen (DE)

(73) Assignee: Liebherr-Werk Ehingen GmbH, Ehingen/Donau (DE)

( * ) Notice: Subject to any disclaimer, the term of this patent is extended or adjusted under 35 U.S.C. 154(b) by 0 days.

(21) Appl. No.: 14/830,637

(22) Filed: Aug. 19, 2015

(65) Prior Publication Data

US 2016/0221799 A1 Aug. 4, 2016

(30) Foreign Application Priority Data

Aug. 20, 2014 (DE) ..... 10 2014 012 422

(51) Int. Cl.

| | |
|---|---|
| ***B66C 13/18*** | (2006.01) |
| ***B66C 23/62*** | (2006.01) |
| ***B66C 23/82*** | (2006.01) |
| ***B66C 23/90*** | (2006.01) |

(52) U.S. Cl.

CPC ..... *B66C 13/18* (2013.01); *B66C 23/62* (2013.01); *B66C 23/82* (2013.01); *B66C 23/90* (2013.01)

(58) Field of Classification Search

None

See application file for complete search history.

(56) References Cited

U.S. PATENT DOCUMENTS

| | | | | |
|---|---|---|---|---|
| 8,979,148 | B1 * | 3/2015 | Hatton, II | B66C 1/105 212/196 |
| 2012/0312767 | A1 | 12/2012 | Bohnacker et al. | |

FOREIGN PATENT DOCUMENTS

| | | | |
|---|---|---|---|
| DE | 102007056289 | A1 | 4/2009 |
| DE | 102011107754 | A1 | 12/2012 |
| EP | 2055665 | A1 | 5/2009 |

* cited by examiner

*Primary Examiner* — Mussa A Shaawat
*Assistant Examiner* — Kyung J Kim
(74) *Attorney, Agent, or Firm* — McCoy Russell LLP

(57) ABSTRACT

The present invention relates to a process for the automatic movement of the boom system of a crane, in particular a mobile crane, with at least two boom elements. The process includes the following steps: measuring of at least one control parameter and in particular automatic actuation of at least one drive of the boom system depending on the measured control parameter.

18 Claims, 5 Drawing Sheets

AUTOMATIC ERECTION OF A CRANE

CROSS REFERENCE TO RELATED APPLICATION

This application claims priority to German Patent Application No. 10 2014 012 422.3, entitled "Automatic Erection of a Crane," filed on Aug. 20, 2014, the entire contents of which is hereby incorporated by reference in its entirety for all purposes.

TECHNICAL FIELD

The present invention relates to a process for the automatic movement of the boom system of a crane, in particular a mobile crane, with at least two boom elements.

BACKGROUND AND SUMMARY

Cranes with boom systems are known from the prior art. During the assembly of corresponding cranes, the boom elements of the boom system are transferred from a pre-assembled state into a finished assembly state. In this context, the pre-assembled state can for example be a state in which the boom system is essentially set down on a resting or bottom surface. In this process, the crane cannot be used for cranage. The finished assembly state is accomplished after appropriate movement of the boom elements. In this context, the boom system can essentially be away from the resting or bottom surface and at least partly be arranged at an angle from the resting or bottom surface. In so doing, sections of the boom system, such as a main boom for example, can be arranged essentially vertical.

When moving the boom system the problem occurs that moving a boom system is a rather complex sequence of movements that has to be carried out safely, to prevent tipping over or damaging the crane. This requires experienced operators and a lot of time in carrying out the movements. It is therefore an objective of the present invention to simplify the movement of a generic crane or its boom system and to optimize the movement procedure.

According to the present invention, this object is achieved by a process for automatic movement of the boom system of a crane, in particular a mobile crane, with at least two boom elements, wherein the process includes the following steps: Measuring of at least one control parameter; and In particular automatic actuation of at least one drive of the boom system depending on the control parameter measured.

As a result, it advantageously becomes possible to monitor and/or to control/regulate the boom system movement such that tipping over or damaging the crane is prevented.

In a preferred embodiment, it is thus conceivable that the at least one measured control parameter includes a relative angle between the boom and the boom elements and/or the force carried by a guy and/or includes an absolute angle of at least one boom element.

For this purpose, the acquisition or measurement of the aforementioned parameters facilitates monitoring the crane kinematics that is particularly adapted to the geometry of the crane. The relative angle between boom elements can for example be determined from values measured from angle sensors on the main boom and fly jib of the boom system. The guy, which serves for stabilizing the boom system, is subjected to tension for that purpose, so that the forces carried by the guy can also be considered for monitoring the crane kinematics.

In a further preferred embodiment, it is conceivable that the at least one drive includes a luffing cylinder and/or a winch with an adjustable cable stranding mechanism and/or a telescopic cylinder.

For this purpose, the luffing cylinder can be configured for swiveling a main boom, the main boom being pivotable about a horizontal axis. In this context, the main boom itself can be designed as telescopic boom that can be telescopically extended by means of the telescopic cylinder. A winch with an appropriate adjustable cable stranding mechanism moreover can be provided for adjusting the boom system.

In a further preferred embodiment, it is conceivable that the drive is controlled during the movement such, that the at least one measured control parameter is within specific intervals or within one specific interval during the movement at least temporarily.

In a further preferred embodiment, it is conceivable that the at least two boom elements include one fly jib and one main boom.

In a further preferred embodiment, it is conceivable that the fly jib is deposited essentially horizontally and/or onto a dolly truck at the beginning and/or at the end of the movement.

In a further preferred embodiment, it is conceivable that the at least two boom elements of the boom system are essentially horizontally aligned at the beginning and/or at the end of the movement.

In a further preferred embodiment, it is conceivable that a hoisting cable of the crane is not hitched and/or is connected with an auxiliary cable during the movement.

In a further preferred embodiment, it is conceivable that during the movement a pulley head of the fly jib during is held in particular at a constant height at least temporarily and/or that a backhitch is engaged upon reaching a specific relative angle between the boom elements.

BRIEF DESCRIPTION OF THE FIGURES

Further advantages and particulars of the process are illustrated with the aid of the Figures.

Figure 1A:
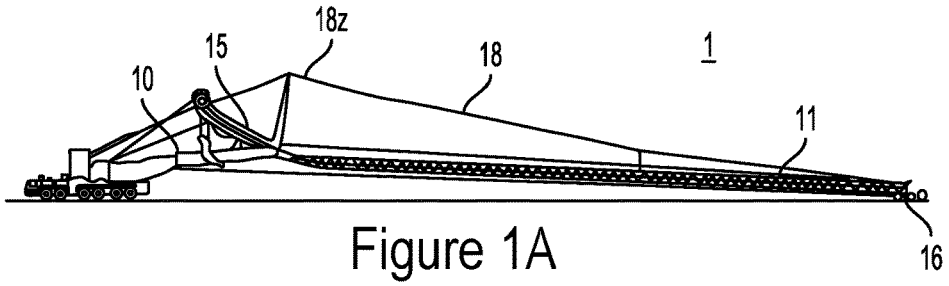
FIG. 1A illustrates the automatic erection with tracking of the luffing jib, pivoted down/folded down erection.

The process according to the present invention is suitable for moving boom systems with at least two boom elements, e.g. main boom 10 and fly jib 11 on a crane 1, in particular a mobile crane 1. The crane 1 can consist of an undercarriage 2 and a superstructure 3. The main boom 10 can be hinged for luffing on the superstructure 3. The fly jib 11 can be hinged for luffing on the superstructure 10. A drive can be provided for both movements or luffing movements. This can be a luffing cylinder 12 or a winch 13 with suitable cabling 14. A spatial guy 15 can be provided on the main boom 10.

Figure 1B:
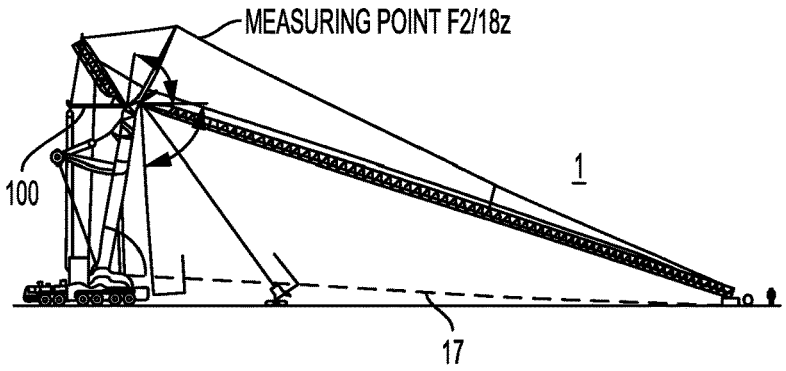
FIG. 1B illustrates another example of the automatic erection with tracking of the luffing jib, pivoted down/folded down erection.
Figure 1C:
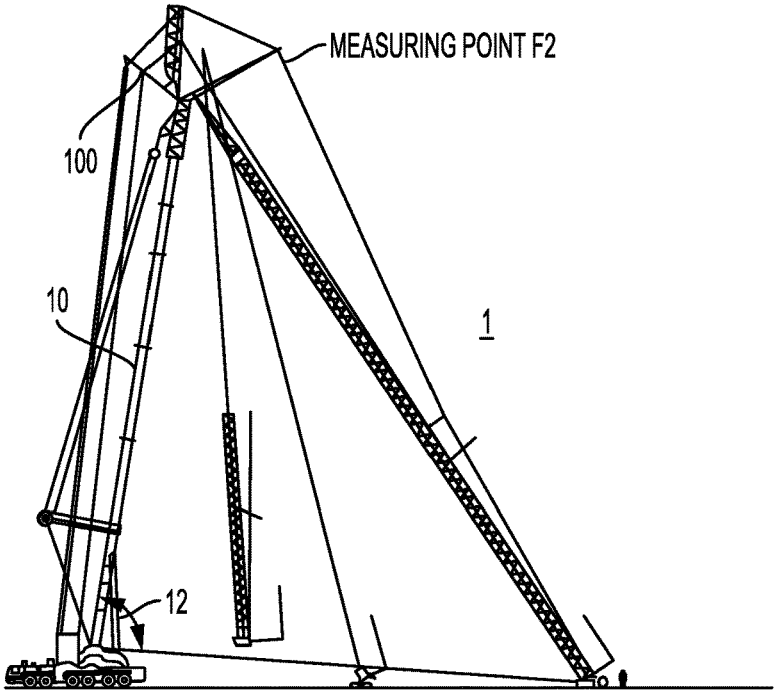
FIG. 1C illustrates yet another example of the automatic erection with tracking of the luffing jib, pivoted down/folded down erection.

In a first potential embodiment of the present invention, FIGS. 1A to 1C show the first case, in which for performing the process according to the present invention the crane 1 is installed until it has reached the state illustrated in FIG. 1A. For this purpose, the main boom 10 of the crane 1 is retracted. The spatial guy 15, shown in FIG. 2C, can be installed on the main boom 10 and optionally on the main boom extension 10*a* from FIG. 2C. The fly jib 11 is closed and connected with the main boom 10. In its flat length, the entire boom system is almost horizontally aligned. The adjustable cable stranding mechanism 14 shown in FIG. 2C is activated, i.e., all necessary stay racks and winches are installed. The haulback cable is hitched. The free end of the fly jib 11 furthermore rests on the dolly truck 16. The hoisting cable is not hitched yet. It is guided across the pulley head and connected with an auxiliary cable 17.

The crane driver adjusts the crane control unit to "automatic erection." In this situation, the crane driver actuates the control lever for luffing the luffing cylinder 12 upward. The crane is then transferred from the status in FIG. 1A to the one of FIG. 1B. For this purpose, the traction measuring strap 18*z* or the measuring point F2 always transmits the force present in the guy 18 to the crane control unit. In this process, the crane control unit actuates the winch 13 from FIG. 2C such that a defined force is present at all times in the guy 18. This force can be 6 tons +/−1, for example. This force causes that the carriage will not be overloaded and the fly jib 11 will not lift off from the dolly truck 16. This will furthermore prevent a slack cable in the adjustable cable stranding mechanism 14. This arrangement is retained until the desired angle of the main boom 10 has been reached. Therefore, during the luffing up or luffing down of the main boom, an automatic tracking of the luffing jib results overall with the aid of the force in the traction measuring strap 18*z*. Here and in the following, the term "tracking" respectively means that a movement, such as that of the luffing jib 11, and another movement, such as that of the main boom 10, follows automatically by means of adjustments and controls, taking into account the control parameter/s.

To transfer the crane 1 into the state shown in FIG. 1C, the crane driver actuates the master switch for the telescoping system. Here too, the traction measuring strap 18*z* or the measuring point F2 always transmits the existing force in the guy 18 to the crane control unit. In this process, the crane control unit actuates the winch 13 such that a defined force is present at all times in the guy 18. In this process, it can happen that the fly jib 11 lifts off from the dolly cart 16. Even then, the monitored force remains the same and causes a slightly tilted position of the fly jib 11.

Once the desired length of the main boom 10 has been reached, the automatic operation is canceled, the spatial guy 15 is tensioned, and the fly jib 11 is directly controlled by the crane driver by means of the winch 13. The telescopic extension or retraction of the main boom to the desired target length therefore occurs with automatic tracking of the fly jib 11 with the aid of the force measured in the traction measuring strip F2. In this context, the laying down is analogously done in the reverse sequence.

Shortly after the pulley head of the fly jib 11 is detached from the dolly cart 16, the auxiliary cable 17 is detached from the hoisting cable in a known manner and the snatch block is hitched.

It is to be mentioned that this system can be used irrespective of the length of the fly jib 11. Shorter booms simply lift off earlier from the dolly cart 16.

Figure 2A:
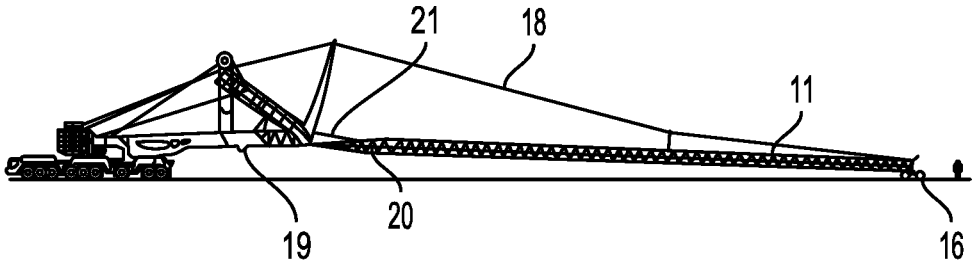
FIG. 2A illustrates the automatic erection with tracking of the luffing jib, flat erection.
Figure 2B:
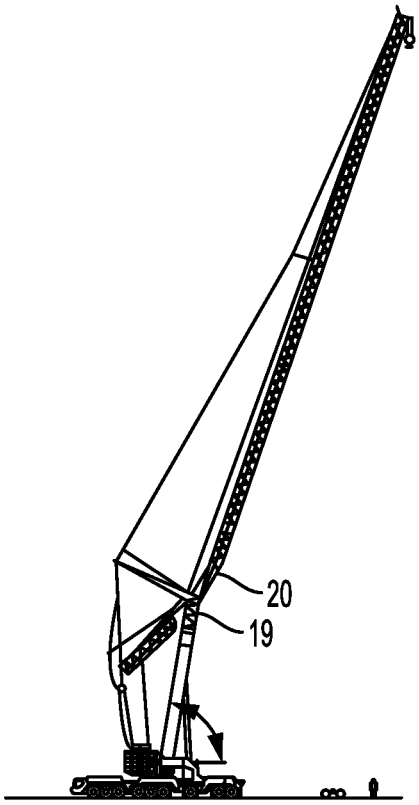
FIG. 2B illustrates another example of the automatic erection with tracking of the luffing jib, flat erection.
Figure 2C:
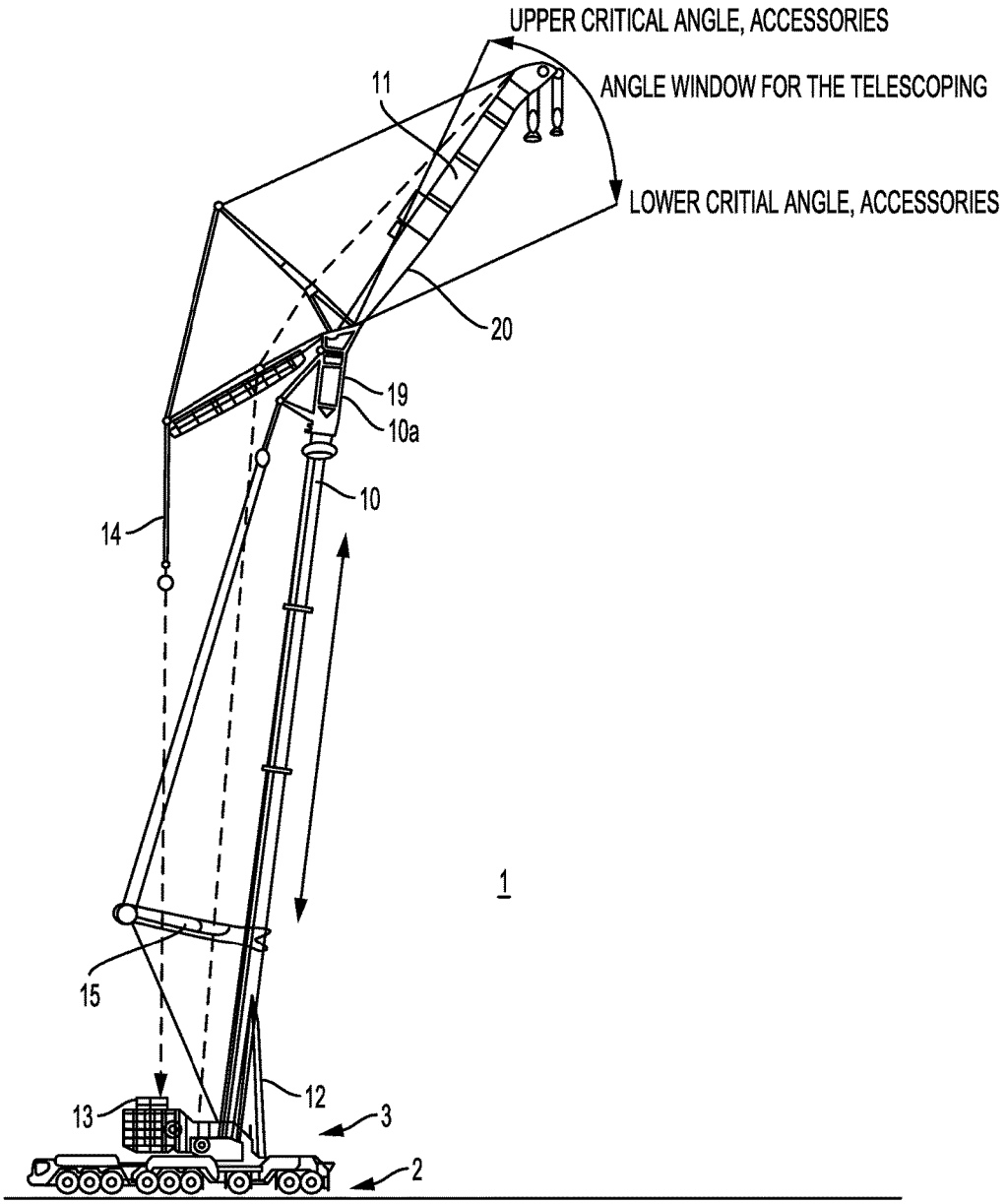
FIG. 2C illustrates yet another example of the automatic erection with tracking of the luffing jib, flat erection.

The second case can be used with small to medium fly jibs 11, as shown in the FIGS. 2A to 2C. This requires no NA-support frame 100 or auxiliary erection frame 100, as can still be seen in FIGS. 1B and 1C. The advantage consists in that the dolly cart 16 is not shifted appreciably, and thus smaller travel with fewer potential obstacles is sufficient.

For this erection process, the relative angle between the main boom 10 and the fly jib 11 can be used as control variable. During this process, the angle sensor 19 in the proximity of the outer end of the main boom 10 and the angle sensor 20 in the proximity of the lower end of the fly jib 11 supplies its values to the control unit of the crane. Said control unit determines the relative angle.

The crane driver adjusts the crane control unit to "automatic erection." In this situation, the crane driver actuates the control lever for luffing the luffing cylinder 12 upward. The crane is then transferred from the status in FIG. 2A to the one of FIG. 2B. The relative angle can be kept at approximately 10° to 20°, advantageously between 15° and 18°.

Shortly after the pulley head of the fly jib 11 is detached from the dolly cart 16, the auxiliary cable 17 is detached from the hoisting cable in a known manner and the snatch block is hitched.

The main boom 10 is subsequently further luffed, as described previously. However, before the relative angle can be used as control variable, it must first be ascertained that the backhitch 21 of the fly jib 11 is engaged. This is done by keeping the height of the pulley head of the flying jib 11 constant during further erection. As a result, the relative angle becomes larger automatically. After reaching a specific relative angle, the backhitch 21 is securely engaged, and the relative angle can be used as an additional control variable. The winch 13 of the adjustable cable stranding mechanism 14 of the fly jib 11 is controlled correspondingly. When the main boom 10 has reached the designated operating angle, e.g. 82°, the crane 1 is in an operating position. The luffing up or luffing down of the main boom 10 is therefore carried out with automatic tracking of fly jib 11 with the aid of a relative angle.

FIG. 2C shows that the main boom 10 is still extended telescopically, subsequently to the situation shown in FIG. 2B. As the control variable for the automatic operation of the winch 13, the following values can then be used, for example: the relative angle between main boom 10 and fly jib 11 that has been previously used above, the absolute angle of the fly jib 11 or also the table end of the luffing movement of the fly jib. In this case, small control windows exist, if it involves a long fly jib 11.

Figure 3A:
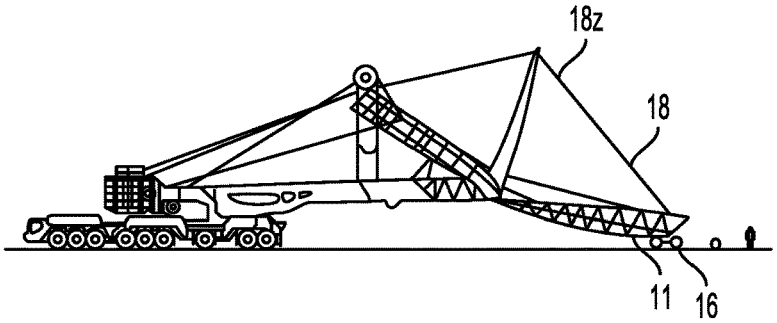
FIG. 3A illustrates the automatic erection with tracking of the luffing jib, angled erection.
Figure 3B:
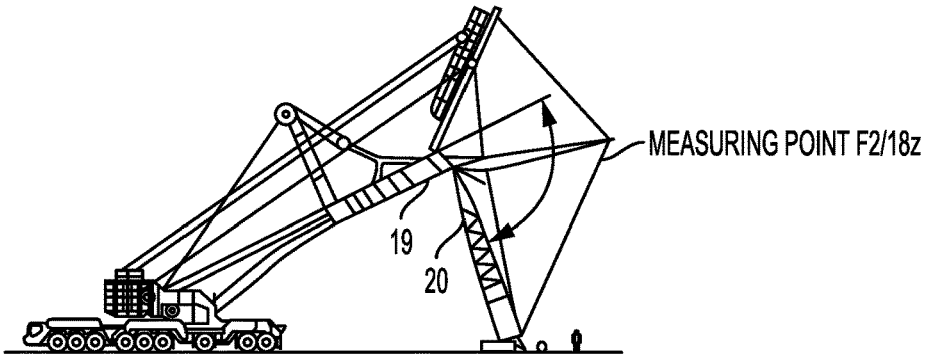
FIG. 3B illustrates another example of the automatic erection with tracking of the luffing jib, angled erection.

In the third case, the transition from the FIG. 3A to FIG. 3B is carried out analog to case 1 on a case-by-case basis. Alternatively, the relative angle between the main boom 10 and the fly jib 11 could also be used as control variable. For this purpose, a relative angle of approximately 100° would be proposed. Once this is reached, then the fly jib 11 can detach from the dolly cart 16.

Figure 3C:
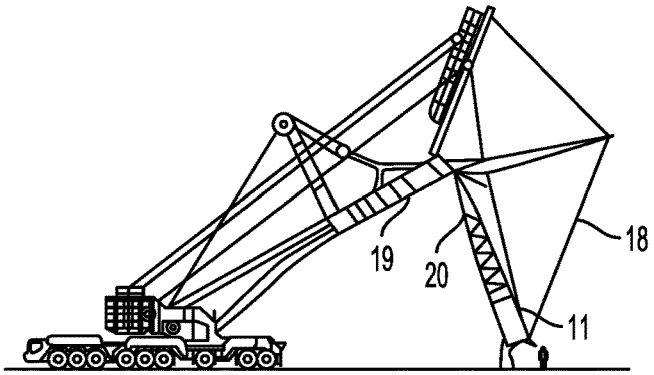
FIG. 3C illustrates yet another example of the automatic erection with tracking of the luffing jib, angled erection.

FIG. 3C shows the situation after the fly jib 11 has detached from the dolly cart 16, and the snatch block is hitched.

Figure 3D:
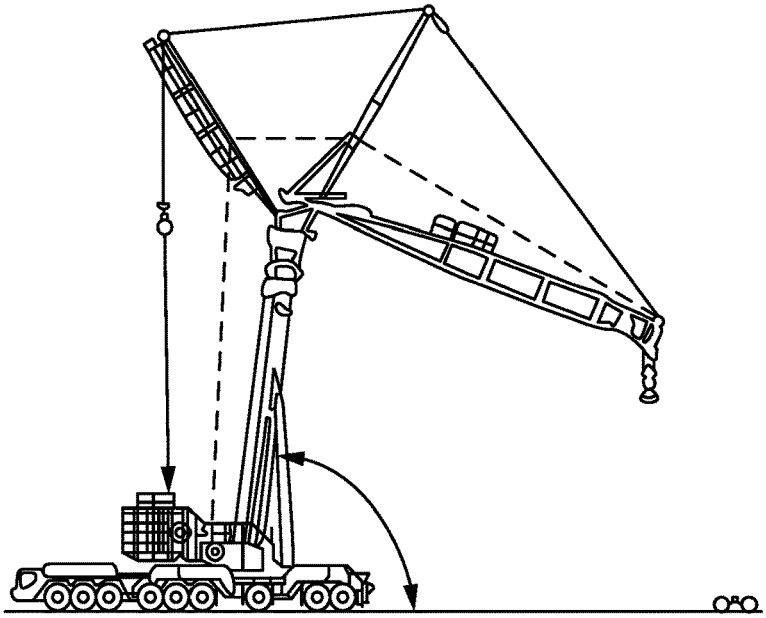
FIG. 3D illustrates a further example of the automatic erection with tracking of the luffing jib, angled erection.
Figure 3E:
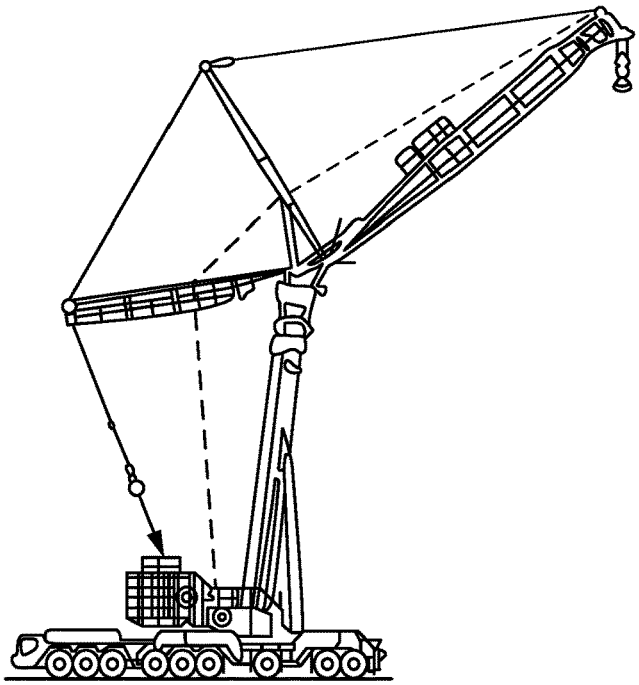
FIG. 3E illustrates illustrates yet a further example of the automatic erection with tracking of the luffing jib, angled erection.

FIG. 3D shows the further erection of the main boom 10. Since the crane control unit tracks the fly jib 11 for moving the main boom 10 with the aid of the relative angle, it directs the fly jib 11 in direction of the desired position immediately. This makes it possible to decrease the setup time. According to the present invention, the luffing up or luffing down of the main boom 10 is therefore carried out with automatic tracking of the fly jib 11 with the aid of the relative angle between main boom 10 and fly jib 11, which is kept constant until the main boom 10 has reached its desired main boom angle. Only thereafter, the luffing up of the fly jib 11 is carried out until it has reached the desired luffing angle, as can be seen from FIG. 3E. Alternatively or additionally, the luffing up or luffing down of the main boom 10 can also be carried out with automatic tracking of the fly jib, using the force in the traction measuring strip F2 or 18*z*.

The further telescopic extension of the main boom 10 and the optional tracking of the fly jib 11 is carried out according to the illustration in FIG. 2C. The laying down is analogously done in the reverse direction. During the telescoping process, the luffing jib or the fly jib 11 can be kept at a specific angle window or at a specific angle. The control can be carried out using the angle sensors on the main boom and on the accessories, or on the luffing jib of the fly jib 11.

The invention claimed is:

1. A process for automatic movement of a boom system of a crane with at least two boom elements comprising a fly jib and a main boom, wherein the process includes the following steps:

while controlling a drive of the main boom to move the main boom, measuring at least one control parameter; and during the movement of the main boom, automatically actuating a drive of the fly jib depending on the control parameter measured, wherein the automatic actuation of the drive of the fly jib during the movement of the main boom maintains the at least one measured control parameter within specific intervals or within one specific interval at least temporarily, and wherein the at least one measured control parameter includes one or more of a relative angle between the boom elements and a force carried by a guy of the fly jib.

2. The process according to claim 1, wherein the specific intervals or the one specific interval comprises one or more of 10 to 20 degrees for the relative angle and 5 to 7 tons for the force.

3. The process according to claim 1, wherein the drive of the main boom includes at least one of a luffing cylinder, a winch with an adjustable cable stranding mechanism, and a telescopic cylinder, and wherein the drive of the fly jib includes at least one of a luffing cylinder, a winch with an adjustable cable stranding mechanism, and a telescopic cylinder.

4. The process according to claim 1, wherein the fly jib is deposited essentially horizontally and/or onto a dolly truck at a beginning and/or at an end of the movement.

5. The process according to claim 1, wherein the at least two boom elements of the boom system are essentially horizontally aligned at a beginning and/or at an end of the movement.

6. The process according to claim 1, wherein, during the movement, a hoisting cable of the crane is not hitched and/or is connected with an auxiliary cable.

7. The process according to claim 6, wherein a pulley head of the fly jib is kept constant during the movement at least temporarily including at a constant height, and/or that when reaching a specific relative angle between the boom elements, a backhitch is engaged, wherein the crane is a mobile crane.

8. The process according to claim 7, wherein the main boom is telescoped at a beginning and/or at an end of the movement, wherein the at least one control parameter is used for controlling/regulating the movement.

9. The process according to claim 1, wherein the at least one measured control parameter includes an absolute angle of at least one boom element.

10. A process, comprising:

automatic movement of a boom system of a mobile crane with at least two boom elements including a main boom and a fly jib, including during movement of the main boom via a drive of the main boom, measuring at least one control parameter; and automatically actuating a drive of the fly jib depending on the control parameter measured, wherein the drive of the fly jib is controlled during the movement to maintain the at least one measured control parameter within a specific interval during the movement at least temporarily.

11. The process according to claim 10, wherein the at least one measured control parameter includes at least one of a relative angle between the boom elements and a force carried by a guy.

12. The process according to claim 11, wherein the drive of the main boom includes at least one of a luffing cylinder, a winch with an adjustable cable stranding mechanism, and a telescopic cylinder, and wherein the drive of the fly jib includes at least one of a luffing cylinder, a winch with an adjustable cable stranding mechanism, and a telescopic cylinder.

13. The process according to claim 10, wherein the fly jib is deposited horizontally and onto a dolly truck at a beginning and/or at an end of the movement.

14. The process according to claim 13, wherein the at least two boom elements of the boom system are horizontally aligned at the beginning and/or at the end of the movement.

15. The process according to claim 13, wherein, during the movement, a hoisting cable of the crane is not hitched.

16. The process according to claim 15, wherein a pulley head of the fly jib is kept constant during the movement.

17. The process according to claim 16, wherein the main boom is telescoped at the beginning and/or at the end of the movement, wherein the at least one control parameter is used for controlling/regulating the movement.

18. The process according to claim 10, wherein the at least one measured control parameter includes an absolute angle of at least one boom element.

* * * * *